US009406992B2

(12) United States Patent
Goritz

(10) Patent No.: US 9,406,992 B2
(45) Date of Patent: Aug. 2, 2016

(54) MICROWAVE ARRANGEMENT FOR THE TRANSMISSION OF HIGH-FREQUENCY SIGNALS

(71) Applicant: Rohde & Schwarz GmbH & Co. KG, Munich (DE)

(72) Inventor: Raimon Goritz, Berlin (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 106 days.

(21) Appl. No.: 14/320,600

(22) Filed: Jun. 30, 2014

(65) Prior Publication Data

US 2015/0002242 A1 Jan. 1, 2015

(30) Foreign Application Priority Data

Jul. 1, 2013 (DE) ..... 10 2013 212 800
Jul. 8, 2013 (DE) ..... 10 2013 213 297

(51) Int. Cl.
*H01P 5/12* (2006.01)
*H01P 5/16* (2006.01)
*H01P 5/08* (2006.01)

(52) U.S. Cl.
CPC . *H01P 5/16* (2013.01); *H01P 5/085* (2013.01)

(58) Field of Classification Search
CPC ..... H01P 5/16; H01P 5/12; H01P 5/085
USPC ..... 333/124–129, 132, 134, 136
See application file for complete search history.

(56) References Cited

U.S. PATENT DOCUMENTS 4,721,929 A * 1/1988 Schnetzer ..... H01P 5/12 333/127
5,223,809 A 6/1993 Myer
9,059,491 B2 * 6/2015 Lim ..... H01P 1/2039
2003/0189246 A1 10/2003 Iwaki et al.

FOREIGN PATENT DOCUMENTS

KR 100863409 B1 10/2008

OTHER PUBLICATIONS

Yao, et al., "A Band-Notched Ultra-Wideband 1 to 4 Wilkinson Power Divider Using Symmetric Defected Ground Structure", IEEE 1-4244-0878-4/07, Jun. 9, 2007.

* cited by examiner

*Primary Examiner* — Robert Pascal
*Assistant Examiner* — Kimberly Glenn
(74) *Attorney, Agent, or Firm* — Potomac Technology Law, LLC

(57) ABSTRACT

The invention relates to a microwave arrangement for the transmission of high-frequency signals of high powers comprising a microstrip conductor on an upper side of a substrate. The microstrip line comprises a multi-stage signal splitter and a ground surface on an underside of the substrate disposed opposite to the upper side. A defected ground structure is introduced into the ground-surface below a first stage of the signal splitter. Further a power combiner and/or a power splitter with a microwave arrangement according to example embodiments of the invention.

12 Claims, 12 Drawing Sheets

MICROWAVE ARRANGEMENT FOR THE TRANSMISSION OF HIGH-FREQUENCY SIGNALS

CROSS-REFERENCE TO RELATED APPLICATION(S)

The present application claims priority to German Patent Application Nos. DE 102013212800.2 (filed Jul. 1, 2013) and DE 102013213297.2 (filed Jul. 8, 2013), the entireties of which are incorporated herein by reference.

FIELD OF THE INVENTION

The invention relates to a microwave arrangement for the transmission of high-frequency signals predominantly of high powers, especially a power combiner and/or a power splitter.

For broadband amplifiers in high-frequency technology, power combiners are often provided in order to combine signals from different signal sources to form a signal sink. Furthermore, power splitters are often provided for broadband amplifiers in high-frequency technology in order to subdivide signals from a signal source for different signals sinks.

BACKGROUND ART

A microwave arrangement which can be operated as a power splitter and/or in a reciprocal manner also as power combiner is known from U.S. Pat. No. 5,223,809. In this context, coaxial lines are used to connect the inputs and outputs of the signal combiner and/or signal splitter correspondingly.

Power combiners and/or power splitters should be capable of being manufactured as cost favourably as possible, wherein the signals to be transmitted should only be minimally attenuated. Accordingly, power distributors and/or power combiners should generate very small throughput power losses. If such broadband amplifiers are operated as high-power amplifiers, low losses should be aimed for, especially in order to avoid the development of high levels of heat resulting from losses from the throughput attenuation.

Wilkinson signal splitters are also used as power splitters. The function of a Wilkinson signal splitter is based upon the $\lambda/4$-line transformation ($\lambda$=wavelength), wherein the power of a signal connected to a first signal port is subdivided to form signals of identical power at a second and third signal port. If reflections of the signal occur in one signal path because of a defect in the line and/or an error matching in the line wave-resistances, the respectively other signal path remains uninfluenced by this. The second signal port and the third signal port are accordingly decoupled from one another. The principle of a signal splitter can also be used in a reciprocal manner for a signal combiner.

Signal splitters which are constructed in multiple stages are used internally by the applicant to combine and/or split broadband signals. In this context, several $\lambda/4$-lines are connected to one another in order to realise an increasingly broad bandwidth. One disadvantage of these signal splitters constructed in multiple stages is the requirement, based on construction considerations, to vary the wave-resistance in each stage of the $\lambda/4$-lines contained in this stage. Accordingly, in a first stage of the signal splitter, in which both signal paths are transmitted on a common line portion, high line wave-resistances are required. The line wave-resistances decline progressively with higher stages of the signal part. This requirement means that lines must be introduced with a small line width in the first stage, which become steadily wider in the higher stages of the signal splitter.

A further disadvantage of the multi-stage signal splitters conventionally used internally by the applicant with small line widths in the first stage is that the only part of the main current flows though the ground surface on the second upper side of the substrate, which is also described as a current crowding effect. This effect means that the current flows primarily in the region of the ground surface directly below the microstrip line arranged on the first upper side of the substrate.

For these reasons, it is necessary to design signal splitters and/or signal combiners with relatively low line wave-resistances in the first stage.

In order to solve this problem, a relatively thicker substrate can be used, for example. Since the maximal thickness of the substrate should not exceed one tenth of the wavelength of the highest frequency to be transmitted, design limits are rapidly reached in this context. Such realizations are enormously cost intensive especially in high-frequency technology.

What is needed, therefore, is a microwave arrangement which transmits broadband signals with high powers and very high frequencies with in a low-loss manner.

SUMMARY OF THE INVENTION

Embodiments of the present invention advantageously address the foregoing requirements and needs, as well as others, by providing a microwave arrangement which transmits broadband signals with high powers and very high frequencies with in a low-loss manner. Accordingly, example embodiments of the present invention concerns a microwave arrangement for the transmission of high-frequency signals of high powers. By way of example, such a microwave arrangement provides a microstrip conductor on one upper side of a substrate, wherein the microstrip conductor comprises a multi-stage signal splitter. The microwave arrangement further comprises a ground surface on an underside of the substrate disposed opposite to the upper side. Further, a defected ground structure may be introduced into the ground surface below a first stage of the signal splitter.

In accordance with example embodiments, the multi-stage signal splitter is a multi-stage Wilkinson splitter. The signal splitter comprises a first signal port, a second signal port and a third signal port. The power of a signal at the first signal port is identical to the power of a signal at the second signal port plus the power of a signal at the third signal port. The first stage of the signal splitter provides a signal-distribution point. With this construction, a Wilkinson power splitter is obtained.

By way of example, In order to reduce the line wave-resistance of the microstrip conductors, in particular of the first stage of the signal splitter, in order to transmit signals with high current powers via the microwave arrangement, the cross-section of the microstrip conductor of the microwave arrangement is configured for high current densities to be transmitted. For this purpose, the microstrip line is preferably embodied to be broader especially at the first signal port of the signal splitter. Through the widening of the microstrip line, the capacitance per unit length C' of the line equivalent circuit diagram is necessarily increased. The resulting line wave-resistance of the microstrip line accordingly becomes significantly smaller. Corresponding to the structural requirement for multi-stage signal splitters that the first stage of the signal splitter provide the largest line wave-resistance, a compensation of this line wave-resistance, which has become smaller because of the relatively broader microstrip line, should be implemented in order to allow a power matching and low-loss transmission of the signals. For this purpose, the defected ground structure is introduced according to an embodiment of the invention below the first stage of the signal splitter, because this introduced defected ground structure increases the inductance per unit length L' of the microstrip line.

In further accordance with example embodiments, in a combination of the relatively wider microwave line on the upper side of the substrate and of the defected ground structure on the underside of the substrate, a compensation of the capacitance increase generated by the relatively wider microstrip conductors of the first stage of the signal splitter takes place. As a consequence of this compensation, the line wave-resistance of the relatively wider microstrip line is identical to the line wave-resistance of a structurally required, relatively narrower microstrip line. Accordingly, by introducing the defected ground structure, a relatively wider microconductor structure is made possible in the first stage without increasing the throughput attenuation of a signal to be transmitted.

In an example embodiment, the defected ground structure corrects the complex line wave-resistance of the microstrip conductor in the first stage of the signal splitter because of a required minimal width of the microstrip conductor. This requirement on the minimal width results from the high current densities to be transmitted in the transmission of signals with a high throughput power, especially a throughput power up to 3 kW.

In a further example embodiment, the signal splitter comprises at least one second stage, wherein the first stage of the signal splitter and the second stage of the signal splitter each provide a first λ/4-line and a second λ/4-line. The width of the first and the second λ/4-line of the first stage is identical to the width of the first and second λ/4-line of the second stage.

By way of example, For the transmission of high-frequency signals via the microwave arrangement according to the invention, and especially a multi-stage signal splitter in the signal path, a power matching of the microwave arrangement is required for the low-loss transmission. In this context, the signal with the largest power is fed in and/or tapped at the first signal port of the signal splitter. For this purpose, the first stage of the multi-stage signal splitter, which is arranged nearest to the first signal port, preferably provides the highest line wave-resistance. As a result of the defected ground structure according to the invention, the first and the second stage can be embodied with microstrip conductors of identical width, so that the ohmic losses can be reduced and manufacturing costs minimised.

In an example embodiment, the defected ground structure is a formed recess in the ground surface. Through the recess in the ground surface, metallic material is saved and a compensation of the reduced line wave-resistance is achieved in a very simply realised manner through the width-related, enlarged capacitance per unit length of the microstrip structure.

In a further example embodiment, the defected ground structure is a formed recess in the ground surface, wherein the shape of the recess of the defected ground structure is formed corresponding to the shape of the first stage of the signal splitter of the microstrip conductor. In this manner, the relatively larger capacitance generated by the relatively wider line is compensated by a corresponding removal of the identical metallic surface on the underside of the substrate. The line wave-resistance accordingly remains constant, and signals with very high power densities and correspondingly high currents can be transmitted via the microwave arrangement.

In a further example embodiment, the defected ground structure is a formed recess in the ground surface, wherein the shape of the recess of the defected ground structure provides a first two-dimensional recess and a second two-dimensional recess. In this context, the first two-dimensional recess is connected to the second two-dimensional recess via a web which is thin relative to the two-dimensional recesses, wherein the first and/or second λ/4-line of the first stage of the signal splitter is arranged on the upper side of the substrate orthogonally to the widening direction of the web. Through this spatial proximity of the defected ground structure with reference to the microstrip line to be compensated, an increase in the inductance per unit length L' of the line wave-resistance is obtained.

In particular, at least two defected ground structures are introduced into the ground surface in order to improve the compensation of the line wave-resistance reduced because of the relatively wider microstrip conductor. This achieves a symmetrical compensation and reduces the ohmic losses on the line.

In particular, a resistor and/or a capacitor and/or a coil are connected in parallel to the defected ground structure. This has the advantage that the transmission behaviour of the microwave arrangement is varied in a frequency-dependent manner. Especially with the use of the microwave arrangement as a signal splitter, a low-pass characteristic is obtained by means of the resistor and/or the capacitor and/or the coil in parallel to the defected ground structure. This causes the signal splitter to act as a filter and, in consequence, leads to an improved subdivision of the signal. The resistor and/or capacitor and/or coil introduced is arranged on the second upper side of the substrate and changes the resonant frequency of the signal splitter.

In an example embodiment, a first connection of a coaxial line is connected to the first signal port of the signal splitter, wherein the coaxial line provides a line wave-resistance value different from the first connection at a second connection remote from the first connection. In particular, the coaxial line is embodied with an inner conductor, which provides a decreasing inner-conductor diameter starting from the first connection of the coaxial line towards the second connection of the coaxial line.

In a further example embodiment, the substrate is arranged with its second upper side on a metallic element, wherein the metallic element provides the ground surface of the microwave arrangement and wherein the metallic element provides a milled region within the region of the defected ground structure. The milled region ensures that the electromagnetic effect of the defected ground structure is preserved.

In a further example embodiment, the metallic element is a cooling element for the removal of heat which arises through the transmission of signals with high power via the microwave arrangement.

In a further example embodiment, every stage of the multi-stage signal splitter provides a load-balancing resistor for the compensation of manufacturing tolerances, wherein this load-balancing resistor is arranged in a milled region of the substrate. Alternatively, only one load-balancing resistor is provided for the entire multi-stage signal splitter.

In a further example embodiment, a shielding plate is arranged above the first upper side of the substrate. This shielding plate protects the microwave arrangement on the one hand from interference from interfering high-frequency signals. On the other hand, interference signals generated by the microwave arrangement do not influence other components in the immediate proximity of the microwave arrangement.

In particular, signals in a frequency band of a few hundred megahertz up to several gigahertz, preferably from 500 MHz to 4 GHz are transmitted by means of the microwave arrangement. Example embodiments of the present invention also cover a power combiner and/or a power splitter which provides a microwave arrangement of the type described here.

BRIEF DESCRIPTION OF THE DRAWINGS

Various example embodiments of the present invention are described in greater detail by way of example with reference to the Figures of the drawings. In this context, elements with identical function are shown with identical reference numbers. The Figures are not drawn to scale; in particular, individual elements may be illustrated in a magnified scale and/or in a simplified manner. The drawings show.

DETAILED DESCRIPTION OF EMBODIMENTS

Figure 1:
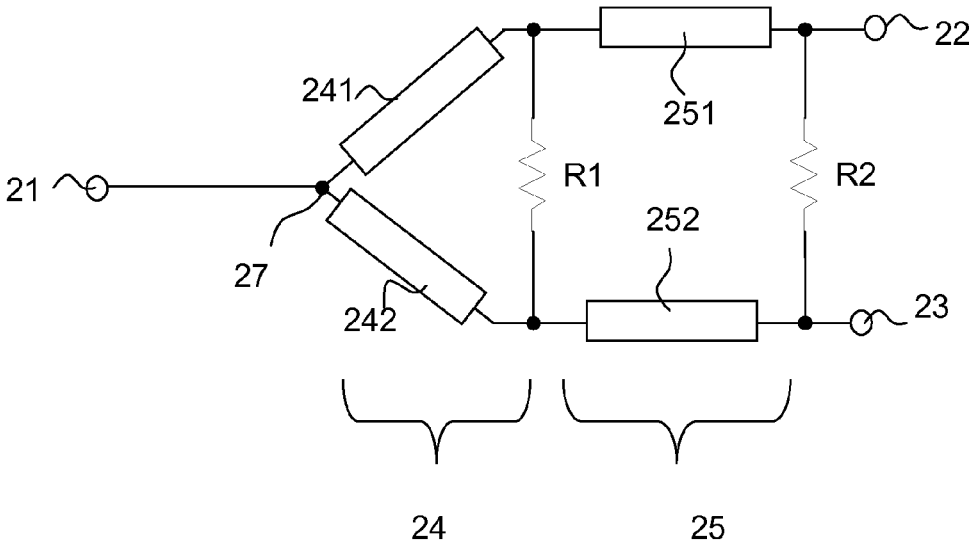
FIG. 1 illustrates a circuit diagram of a two-stage Wilkinson signal splitter.

FIG. 1 shows a circuit diagram of a two-stage Wilkinson signal splitter 2. The signal splitter 2 provides a first signal port 21 which leads to a signal-distribution point 27. A first λ/4-line 241 and a second λ/4-line 242 of a first stage 24 of the signal splitter 2 are arranged at the signal-distribution point 27. X is the average wavelength of the wavelength band to be transmitted. The ends of the two λ/4-lines 241 and 242 remote from the signal-distribution point 27 are connected to an ohmic resistor R1 as the load-balancing resistor in order to compensate non-ideal embodiments of the lines 241 and 242. A second stage 25 with respectively a first λ/4-line 51 and a second λ/4-line 252 is arranged adjoining the first stage 24 of the signal splitter 2. In this context, the first λ/4-line 251 of the second stage 25 of the signal splitter 2 is connected with a first end to the first λ/4-line 241. The first λ/4-line 251 of the second stage 25 of the signal splitter 2 is connected with a second end remote from the first end to a second signal port 22.

Correspondingly, the second λ/4-line 252 of the second stage 25 of the signal splitter 2 is connected with a first end to the second λ/4-line 242. The second λ/4-line 252 of the second stage 25 of the signal splitter 2 is connected with a second end remote from the first end to a third signal port 23. From the second signal port 22 to the third signal port 23, a second ohmic resistor R2 is arranged as a load-balancing resistor in order to compensate non-ideal embodiments of the lines 251 and 252.

The circuit diagram shown in FIG. 1 can be used as a power splitter and also reciprocally as a power combiner, because it is a passive arrangement. The function of the signal splitter is based upon the λ/4-line transformation. In this context, a high-power, high-frequency signal is fed in at the signal port 21 with a total power. The total power is subdivided at the signal-distribution point 27 into identical parts and identical phase, respectively at the second signal port 22 and the third signal port 23. To allow a high throughput power with low throughput attenuation of the signal to be transmitted, the signal splitter 2 should be power matched. If signal sources and/or signal sinks with identical wave-resistance, for example, Z=50Ω are connected at the signal ports 21 to 23, the following reflect line wave-resistances $Z_L$ of the individual λ/4-line:

First λ/4-line 241 of the first stage 24=66Ω
Second λ/4-line 242 of the first stage 24=66Ω
First λ/4-line 251 of the second stage 25=56Ω
Second λ/4-line 252 of the second stage 25=56Ω
First load-balancing resistor R1=93Ω
Second load-balancing resistor R2=155Ω

It is problematic with this multi-stage signal splitter 2 that the first λ/4-line 241 and the second λ/4-line 242 of the first stage 24 of the signal splitter 2 provide the maximum line wave-resistance $Z_L$. In this context, the first stage 24 should be able to transmit signals with the maximum power to the signal-distribution point 27.

In order to transmit high currents via the first stage 24, the first λ/4-line 241 and the second λ/4-line 242 of the first stage 24 of the signal splitter 2 should be embodied wider. This line widening with the microstrip line causes an enlargement of the capacitance per unit length C'. This enlargement of the capacitance per unit length C' in turn causes a reduction in the line wave-resistance $Z_L$. To continue to operate the signal splitter 2 in a power-matched manner, the increased capacitance per unit length C' should therefore be reduced.

Alongside the first stage 24 and the second stage 25, further stages of the multi-stage signal splitter 2 are not excluded from the idea of the invention. The larger the number of stages of a multi-stage signal splitter 2 is, the larger the bandwidth B the signal to be transmitted can provide. In this context, independently of the number of stages, the first stage 24 of the multi-stage voltage splitter 2 should always be embodied with the highest line wave-resistance value. For example, a three-stage Wilkinson voltage splitter provides a line wave-resistance of 82.4Ω in the λ/4-lines of the first stage, a line wave-resistance of 74.5Ω in the λ/4-line of the second stage and a line wave-resistance of 67Ω in the λ/4-line of the third stage, if all of the signal ports 21 to 23 are to be terminated with a wave-resistance of 5Ω.

The present invention is provided to transmit signals in a low-loss manner, for example, within a frequency band from 500 MHz to 6 GHz, wherein the throughput power of the signal splitter can have values up to 3 kW.

Figure 2:
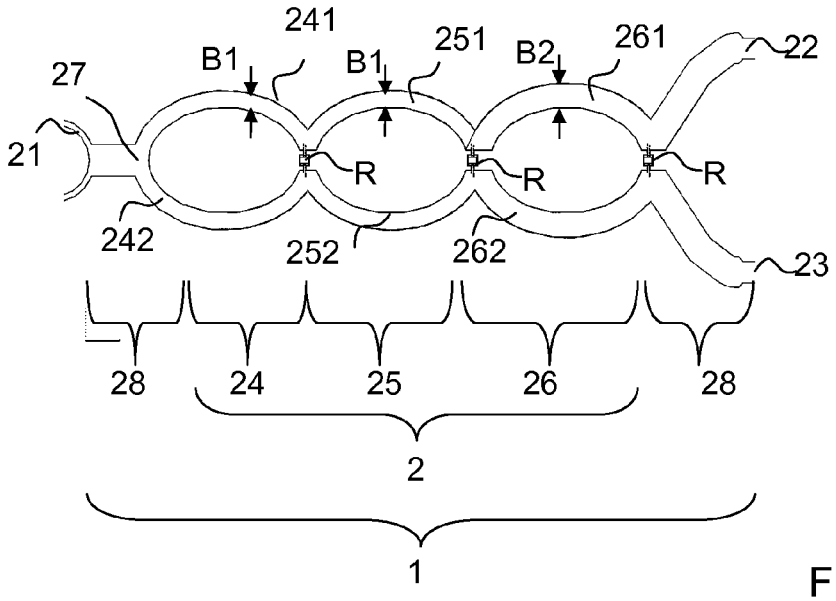
FIG. 2 illustrates a diagram of a microwave arrangement according to example embodiments of the invention.

FIG. 2 shows a plan view of a microwave arrangement according to example embodiments of the invention. This microwave arrangement provides a microstrip conductor 1 on an upper side 31 of a substrate 3 which is not illustrated. A ground surface 4, which, according to the invention, provides a defected ground structure (Defected Ground Structure DGS), is embodied on an underside 32 of the substrate 3, which is not illustrated, disposed opposite to the upper side 31.

The microwave arrangement according to FIG. 2 provides a microstrip conductor 1 with a three-stage Wilkinson signal splitter 2. With reference to FIG. 1, the signal splitter 2 according to FIG. 2 provides a first signal port 21, at which the high-power signal is applied. This signal is subdivided at a signal-distribution point 27 into two signal paths, wherein a signal of half power can be tapped in each case at the second signal port 22 and the third signal port 23. Each of the three stages 24, 25, 26 provides a first λ/4-line 241, 251, 261 and a second λ/4-line 242, 252, 262. Additionally, signal supply lines 29 are provided at each signal port 21, 22, 23, which each provide a wave-resistance $Z_L$ of 50Ω and serve only to transmit the signal to be fed, or respectively tapped, at the signal ports 21, 22, 23 to the voltage splitter 2.

The transmission of the signal is implemented by means of microstrip conductor 1. In this context, the line wave-resistance $Z_L$ is reciprocally proportional to the width B of the microstrip conductor 1. Accordingly, if a microstrip conductor 1 of a relatively higher line resistance $Z_L$ is required, the width B of the microstrip conductor is reduced.

In order to realise different wave-resistances $Z_L$ which are required to guarantee a low-loss, because power-matched, transmission, the third stage 26 of the signal splitter 2 provides a width B2, for example, of 4 mm. By contrast, the second stage 25 of the signal splitter 2 provides a first width B1 which corresponds to half the width B2 and is therefore, for example, 2 mm.

By means of the different widths B1 and B2, different line wave-resistances between the third stage 26 and the second stage 25 are achieved. The wave-resistance $Z_L$ of the third stage 26 is 67Ω because of the embodiment of the microstrip conductor 1 with the width B2. By contrast, the wave-resistance of the second stage 24 is 74.5Ω because of the embodiment of the microstrip conductor 1 with the width B1.

For a power-matched signal transmission, with a termination of the signal ports 21, 22, 23 with 50Ω, the first stage 24 provides a wave-resistance of 82.4Ω. In order to generate this wave-resistance $Z_L$, the λ/4-lines 241, 242 would have to provide a width B0 of 1 mm. The low-loss transmission of high-power signals provided according to the invention is not possible with such a width B0 of the λ/4-lines 241, 242 of the first stage 24 of the voltage splitter 2, since a strong average attenuation of the high-power signal would occur in view of high ohmic losses because of the small width B0 of 1 mm.

To compensate these ohmic losses, the first stage 24 should therefore also be fitted with a microstrip line with a width B1 of at least 2 mm. As a result of the relatively larger width B1 instead of the required width B0, the capacitance per unit length C' of the microstrip conductor 1 is increased. The resulting line wave-resistance $Z_L$ corresponds to the square root of the quotient of the inductance per unit length L' and the capacitance per unit length C'. To compensate the increased capacitance per unit length C', a defected ground structure 5 is introduced according to the invention into the microwave arrangement, as will be explained with reference to the following Figures.

Figure 3A:
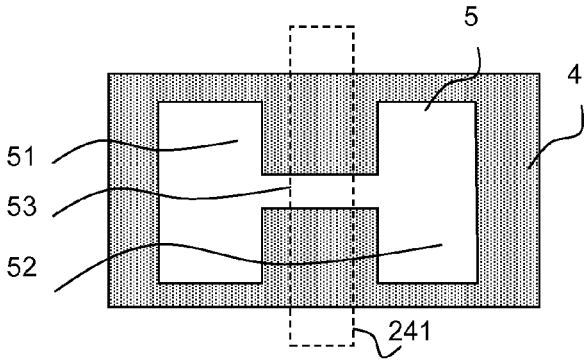
FIG. 3*a*-3*c* illustrate diagrams of defected ground structures according to example embodiments of the invention.
Figure 3B:
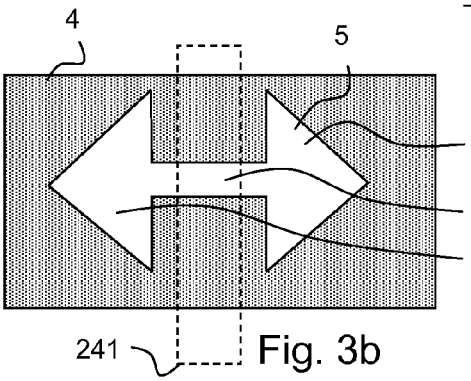
Figure 3C:
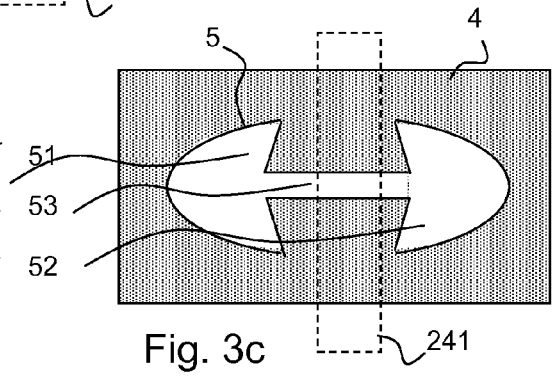

FIGS. 3*a* to 3*c* illustrate different defected ground structures which are introduced into the ground surface 4 on the underside 32 of the substrate 3 in order to compensate the increased capacitance per unit length C', in accordance with example embodiments of the invention.

Defected ground structures 5 (acronym DGS) are used according to the invention to compensate the widening shown in FIG. 2 of the microstrip conductor 1 of the first and second λ/4-line 241, 242 of the first stage 24 of the signal splitter 2 and the resulting enlargement of the capacitance per unit length C'. The structures shown in the FIGS. 3*a* to 3*c* are, in particular, dumbbell shaped. In this context, a first two-dimensional recess 51, a second two-dimensional recess 52 and a connecting web 53 is provided. These two-dimensional recesses 51, 52 and the web 53 of the defected ground structure 5 are introduced into the ground surface 4 on the second upper surface 32 of the substrate 3 of the microwave arrangement.

The defected ground structure 5 is preferably introduced into the second upper side 32 of the substrate 3 in such a manner that the web 53 is arranged orthogonally to the first or second λ/4-line 241, 242 of the first stage 24. This spatial proximity of the defected ground structure 5 to the microstrip conductor 1 of the first stage 24 generates an increase of the inductance per unit length C'. Consequently, the resulting line wave-resistance $Z_L$, formed from the square root of the quotient of inductance per unit length L' and capacitance per unit length C', is constant if a line widening of the first stages 24 of the voltage splitter 2 are provided, as suggested according to FIG. 2. Accordingly, the λ/4-lines 241, 242 to be widened are completely compensated, the ohmic losses are minimised, and a power matching is achieved.

According to FIG. 3*a*, the two-dimensional recesses 51 and 52 are each embodied as a rectangle. According to FIG. 3*b*, the two-dimensional recess 51 and 52 are each embodied as a triangle. In FIG. 3*c*, the two-dimensional recesses are each embodied as semi-ellipsoid areas. The dumbbell-shaped defected ground structures shown in FIGS. 3*a* to 3*c* are exemplary and not necessarily restricting for the subject matter of the invention.

Figure 4:
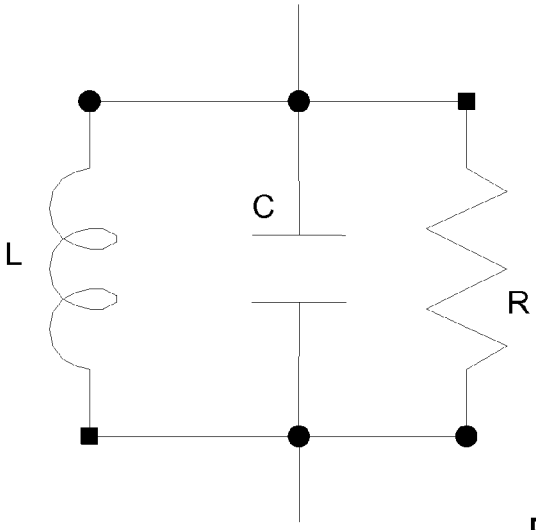
FIG. 4 illustrates a circuit diagram of the defected ground structures of FIGS. 3*a*-3*c* according to example embodiments of the invention.

FIG. 4 shows a circuit diagram of a defected ground structure 5 illustrated according to FIGS. 3*a* to 3*c*. The equivalent circuit diagram of a defected ground structure 5 corresponds to a parallel oscillation circuit comprising an inductance L, a capacitance C and an ohmic resistance R. By embodying the defected ground structure 5 according to one of the shapes shown in FIGS. 3*a* to 3*c*, the inductance L of the equivalent circuit diagram predominates in the parallel resonance circuit.

This inductance L counteracts the capacitance C of the first stage 24 of the microstrip line 1 increased by the widening of the line, so that the resulting line wave-resistance $Z_L$ of the first and second λ/4-line 241 and 242 of the first stage 24 of the signal splitter 2 remains constant.

Figure 5A:
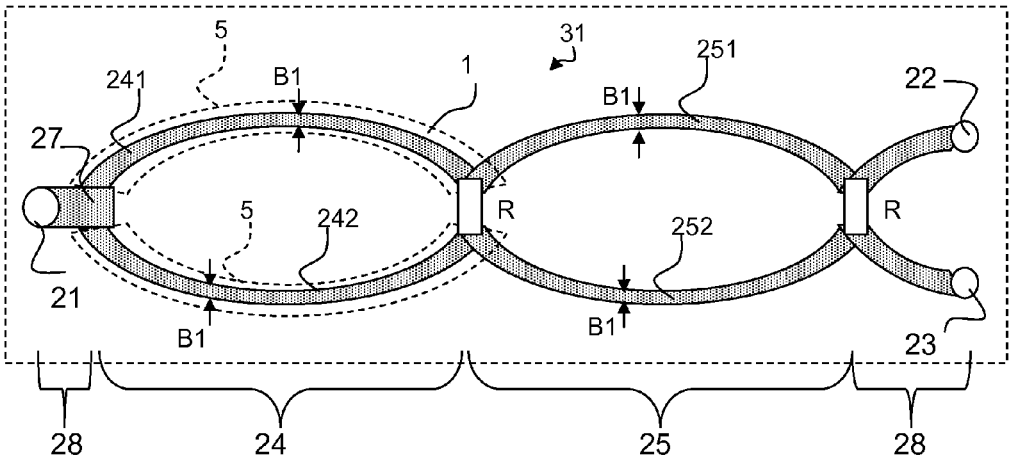
FIG. 5*a*-5*b* illustrate diagrams of a microwave arrangement according to further example embodiments of the invention.
Figure 5B:
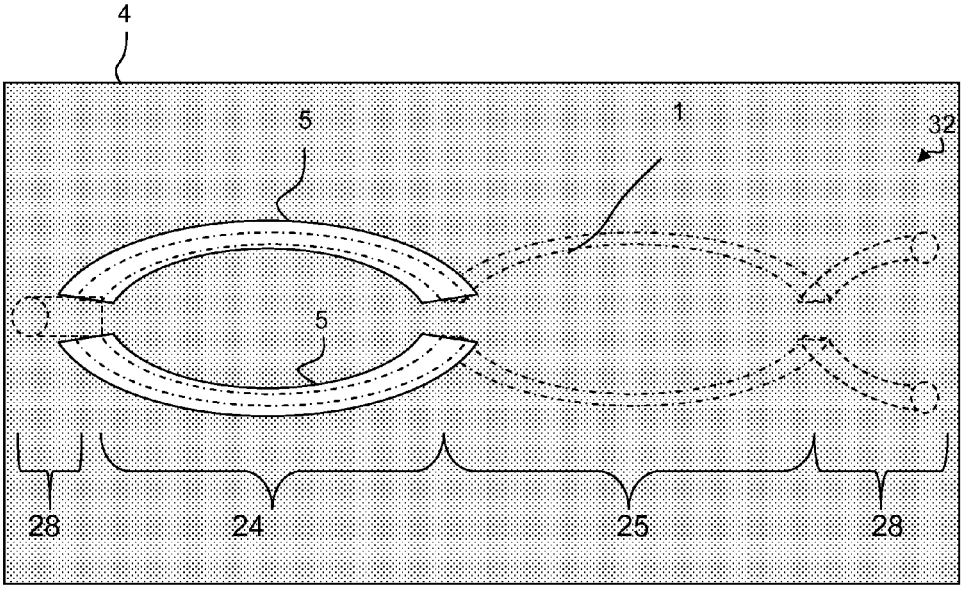

FIGS. 5*a* and 5*b* show diagrams of a microwave arrangement according to further example embodiments of the invention, wherein, reference will be made in the following only to the differences between the embodiments of these figures and the example embodiment according to FIG. 2. Accordingly, FIG. 5*a* shows a plan view of the upper side 31 of the substrate 3. By contrast, FIG. 5*b* shows a plan view of the underside 32 of the substrate 3.

By way of difference from FIG. 2, the voltage splitter 2 is not embodied in three stages but only with a first stage 24 and a second stage 25. Both the first stage 24 and also the second stage 25 provide the identical width B1 of the microstrip conductor 1. Via this microstrip line 1, it is thus possible to transmit signals with a high power density and, resulting from this, high currents, in a low-loss manner. In order to obtain the structurally required line wave-resistance $Z_L$ of the first stage 24 of the Wilkinson voltage splitter 2, a defected ground structure 5 is introduced below this first stage 24 into a second upper side 32 of the substrate 3. This defected ground structure is illustrated with dashed lines in FIG. 5*a* and shows that it provides substantially the same shape as the first and the second λ/4-line 241, 242 of the first stage 24 of the signal splitter 2 of the microstrip conductor 1.

FIG. 5*b* shows the second upper side 32 of the substrate 3. In this context, the second upper side 32 is coated over its full area with a ground surface 4. The defected ground structure 5 introduced into the ground surface 4 is embodied corresponding to the first and second λ/4-line 241, 242 according to FIG. 5*a*. The first stage 24 and the second stage 25 of the signal splitter 2 are illustrated in FIG. 5*b* with dashed lines.

Through the embodiments shown in FIGS. 5*a* and 5*b*, the capacitance C of the microstrip line 1, increased because of the line widening of the first stage 24, is compensated by corresponding recesses in the ground surface 4 as the defected ground structure 5.

Figure 6A:
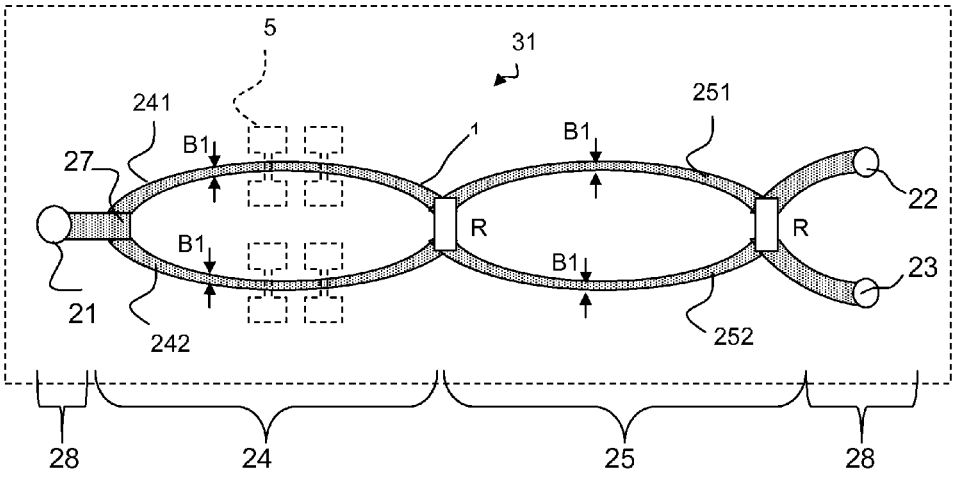
FIG. 6*a*-6*b* illustrate diagrams of a microwave arrangement according to further example embodiments of the invention.
Figure 6B:
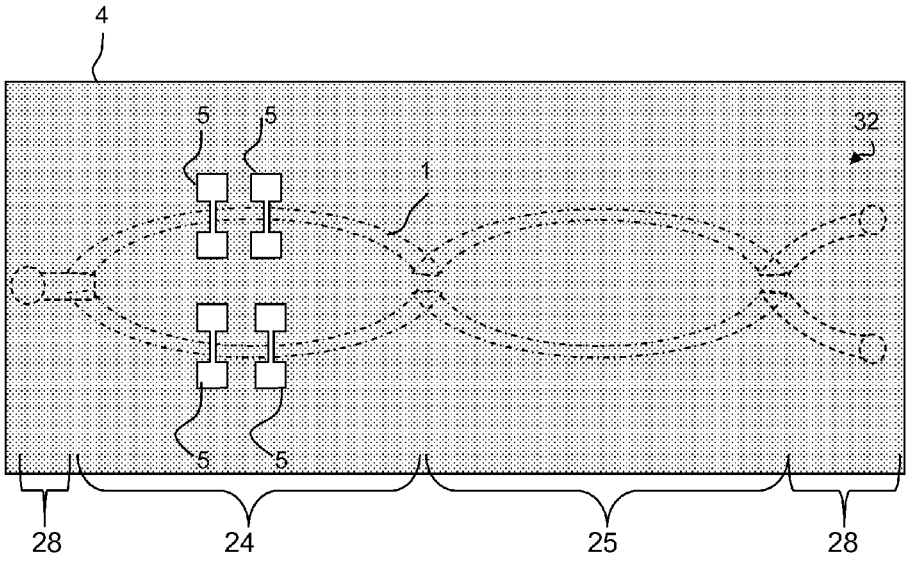

FIGS. 6*a* and 6*b* show diagrams of a microwave arrangement according to further example embodiments of the invention, wherein reference will be made in the following only to the differences between the embodiments of these figures and the embodiments according to FIGS. 5*a* and 5*b*. Corresponding to FIG. 5*a*, a voltage splitter 2 with a first stage 24 and a second stage 25 is also embodied in FIG. 6*a*, wherein the line widths B1 of the first stage 24 and the second stage 25 are identical. To compensate the identical line widths of the first stage 24 and the second stage 25, a defected ground surface 5 is introduced into the underside 32 of the substrate 3, corresponding to FIGS. 3*a* to 3*c*, in each case below the first and the second λ/4-line 241, 242.

The introduction of several defected ground structures 5 in each λ/4-line 241 respectively 242, as shown in FIGS. 6*a* and 6*b* is also included within the idea of the invention.

FIG. 6*b* shows the underside 32 of the substrate 3 corresponding to FIG. 5*b*. The defected ground structures 5 in this context are introduced into the ground surface 4 as a recess and are accordingly simple to realise. The manufacturing costs for such a microwave arrangement can therefore be kept low.

Figure 7A:
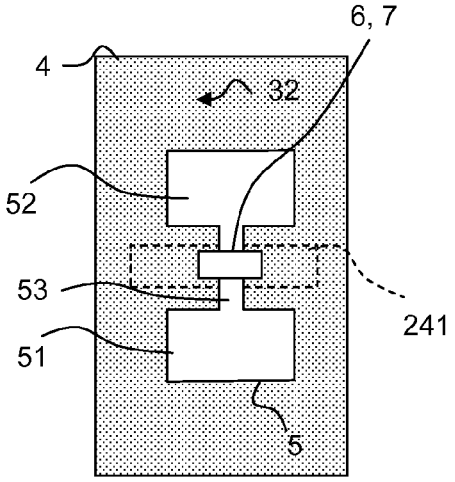
FIG. 7*a*-7*b* illustrate diagrams of the defected ground structures of FIGS. 3*a*-3*c* according to further example embodiments of the invention.
Figure 7B:
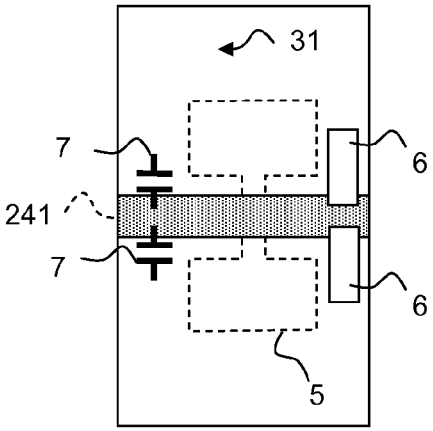

FIG. 7*a*-7*b* illustrate diagrams of a defected ground structure 5 of FIG. 3*a* according to further example embodiments of the invention. In this context, a component, especially a resistor 6, a capacitor 7 and/or a coil is introduced into the defected ground structure 5 in such a manner that the resistance value, the capacitance value and/or the coil value in an equivalent circuit diagram of the defected ground structure 5 according to FIG. 4 is connected in parallel.

The realisation and concrete connection of the component in this context is variable. According to FIG. 7*a*, the web 53 of the defected ground structure 5 is bridged by means of the resistor 6 and/or the capacitor 7. This bridging can be implemented, on the one hand, on the underside 32 of the substrate 3, so that a simplified realisation is achieved.

Alternatively, the resistor 6, the capacitor 7 and/or the coil can be embodied on the first upper side 31 of the substrate 3 as a part of the microwave arrangement, as shown in FIG. 7*b*. In this context, the resistor 6, the capacitor 7 and/or the coil need not be arranged as a discrete component; on the contrary, they can also be realised as strip-conductor structures using microstrip technology on the upper side 31 of the substrate 3.

Figure 8:
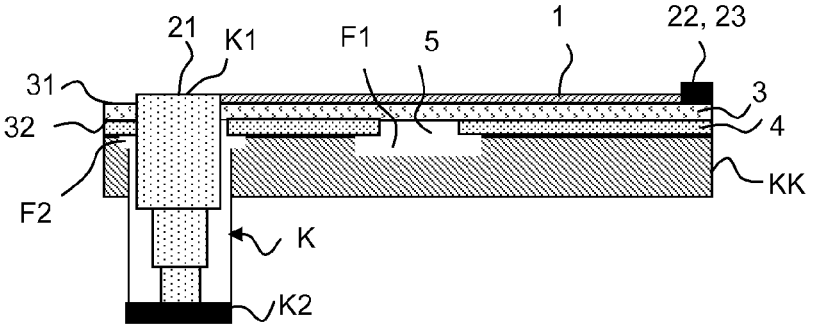
FIG. 8 illustrates a diagram of a microwave arrangement with coaxial line and cooling element according to example embodiments of the invention.

FIG. 8 shows a cross-section through a microwave arrangement according to a further example embodiment. In this context, a substrate 3 is illustrated with an upper side 31 and a lower side 32. The microstrip conductor 1 is embodied above the upper side 31. This microstrip conductor 1 comprises at least one multi-stage signal splitter 2 according to one of the preceding exemplary embodiments. Below a first stage 24 of the multi-stage signal splitter 2, a defected ground structure 5 is introduced. This is introduced into a ground surface 4 below the underside 32.

The microstrip line 1 provides a first signal port 21 on the first upper side 31 of the substrate 3. The signal port 21 is connected to a first connection K1 of the coaxial line K. The first connection K1 provides a first line wave-resistance value, for example, $Z_L$=25Ω. A second connection K2 of the coaxial line K remote from the first connection K1 provides a second wave-resistance value, for example, 50Ω. This coaxial line K accordingly brings about a transformation of a wave-resistance of 25Ω to form a wave-resistance of 50Ω. At the second connection K2 of the coaxial line K, a signal source and/or a signal sink can be connected in a power-matched manner.

The microstrip conductor 1 further provides a second signal port 22 and a third signal port 23. A signal source and/or a signal sink can also be connected in a power-matched manner to this second and third signal port 22, 23.

The connection of the signal ports 21, 22, 23 is dependent upon the use of the microwave arrangement as a power combiner or a power splitter. As a passive arrangement, the microwave arrangement according to the invention can be used in a reciprocal manner. For example, if a high-frequency, high-power signal is connected to the second connection K2 of the coaxial line K, a signal providing half the power of the high-power signal connected can be tapped at each of the signal ports 22, 23 and made accessible to components of a broadband amplifier connected downstream. Alternatively, a signal can be connected to each of the signal ports 22, 23, which can be tapped at the second connection K2 of the coaxial line K as a combined signal.

Below the underside 32 of the substrate 3, a cooling element KK is arranged. As an alternative to the preceding exemplary embodiments, the cooling element KK provides the ground surface 4 of the microwave arrangement according to the invention.

This cooling element KK is provided according to the invention in order to cool the microwave arrangement when high-power signals are fed in and, in particular, to radiate to the environment the heat generated through transmission of the high-power signal.

To avoid influencing the electromagnetic effect of the defected ground structure 5, a milled region F1 at the level of the defected ground structure 5 is preferably introduced into this cooling element KK. The milled region has a depth of, for example, 2 mm. This milled region F1 is provided so that the cooling element KK does not prevent or weaken the electromagnetic effect of the defected ground structure 5.

Figure 9A:
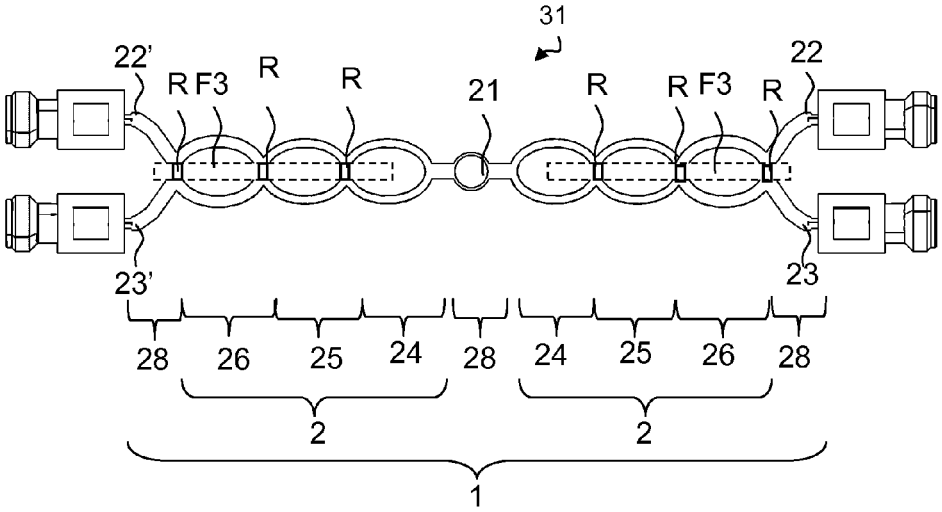
FIG. 9*a*-9*b* illustrate a plan view of the microwave arrangement FIG. 8.
Figure 9B:
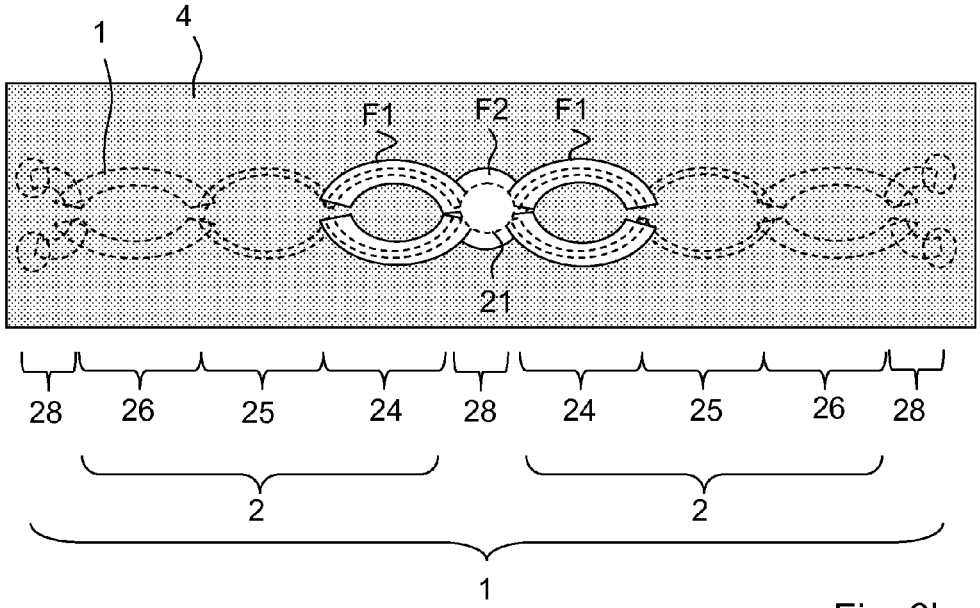

FIGS. 9*a* and 9*b* show a plan view of the microwave arrangement of FIG. 8. In this context, two double Wilkinson signal splitters 2 are used, wherein each Wilkinson signal splitter 2 provides three stages 24, 25, 26. Both Wilkinson signal splitters 2 are constructed in an identical manner, so that the second signal ports 22 and 22' and the third signal ports 23, 23' are embodied in an identical manner. An asymmetric embodiment of the voltage splitters 2 is also included within the idea of the invention.

FIG. 9*a* shows a plan view of the upper side 31 of the substrate 3. At the first signal port 21, the inner conductor of the coaxial line K is connected by means of the first connection K1. For improved shielding, the upper side 31 of the substrate also provides a ground surface 4 in order to decouple the high-frequency signal correspondingly from interfering influences. In FIG. 9*a*, the substrate 3 is provided with a milled region F3 at the positions at which the load-balancing resistors R1, R2, R3 described with reference to FIG. 1 are arranged. The milled region F3 is provided in order to be able to introduce the load-balancing resistors R as far as possible into the substrate 3.

According to FIG. 9*b*, an upper side of the cooling element KK is illustrated, which is connected to the underside 32 of the substrate 3. The upper side of the cooling element KK in this context provides the ground surface 4. Now, in order to integrate the defected ground structure 5 into the ground surface 4, the upper side of the cooling element KK provides a milled region F1 for each defected ground structure 5. This milled region F1 is, for example, 2 mm thick. In order to avoid influencing the connection K1 of the coaxial line K electromagnetically, the upper side of the cooling element KK provides a milled region F2 at the position of the first connection K1 of the coaxial line K. The second signal port 21 is illustrated by suggestion.

Figure 10:
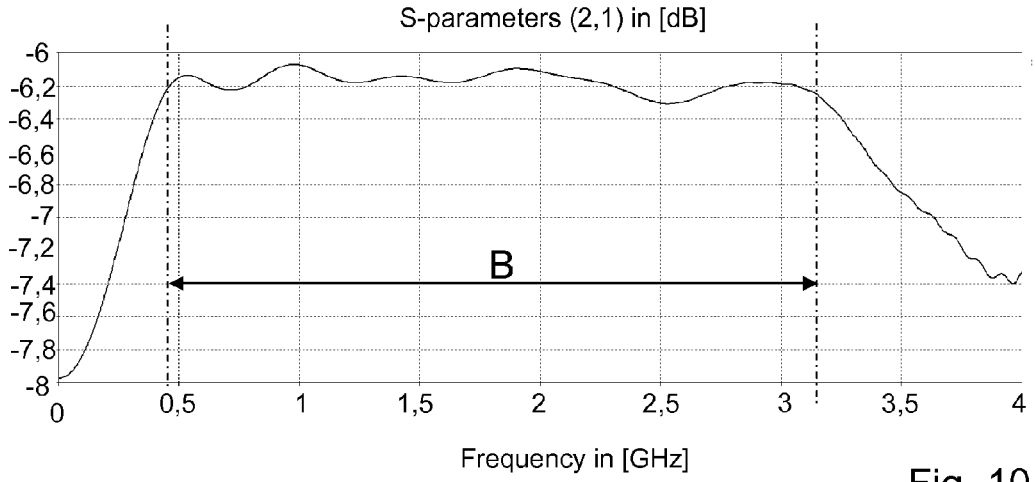
FIG. 10 illustrates a graph of a throughput-attenuation behaviour of the microwave arrangement of FIG. 9*a*-9*b;*

FIG. 10 shows a transmission behaviour of the microwave arrangement of FIGS. 9*a* and 9*b*. It is evident in this context that the microwave arrangement according to the invention can transmit a high-power signal fed in with a frequency from 500 MHz up to a frequency of 3 GHz with low throughput losses of approximately 0.1 dB. Accordingly, the microwave arrangement according to the invention can transmit a throughput power of up to 3 kW. The transmission characteristic shown in FIG. 10 was recorded in the case of a signal fed in at the first signal port 21 with a power of 59 $dB_m$, which corresponds to a throughput power of approximately 800 W.

Figure 11:
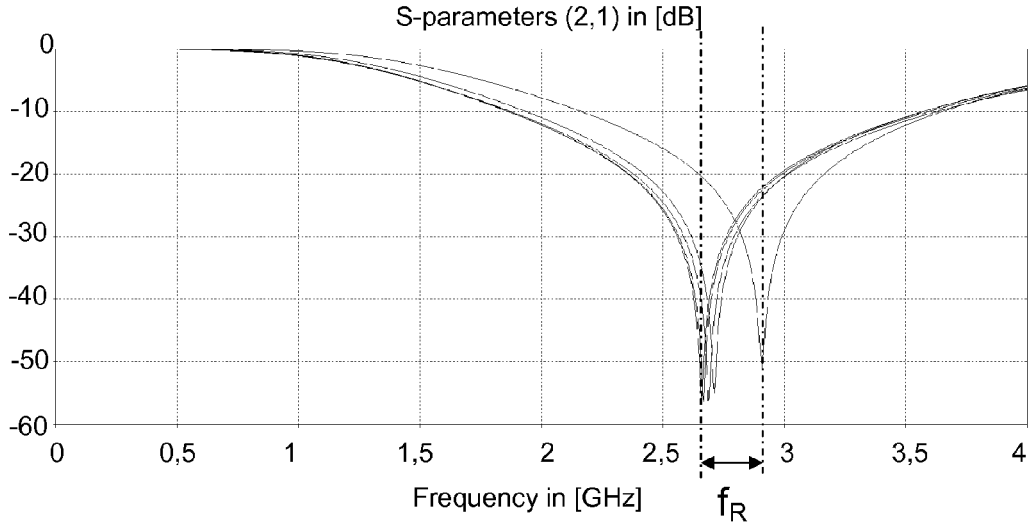
FIG. 11 illustrates a graph of a throughput-attenuation behaviour of the microwave arrangement of FIGS. 7*a*-7*b* with a filter characteristic.

FIG. 11 shows a throughput attenuation behaviour of the microwave arrangement of FIGS. 7*a* and 7*b* with correspondingly adjustable defected ground structures 5 and resulting filter characteristic. In this context, with connection of a resistor 6 and a capacitor 7 in parallel to the defected ground structure, a low-pass is obtained. This low-pass can be used, especially in the case of the subdivision of signals of a signal splitter according to the invention. The resulting resonant frequency $f_R$ is adjustable on the basis of different values for capacitance, ohmic resistance and inductance, between 3.2 and 3.4 GHz. Accordingly, through different connection of the individual stages 24, 25, 26 of the voltage splitter 2, different low-passes can be generated. In this manner, a different signal corresponding to the adjusted resonant frequency $f_R$ is distributed to each signal port 22, 22', 23, 23'.

Figure 12:
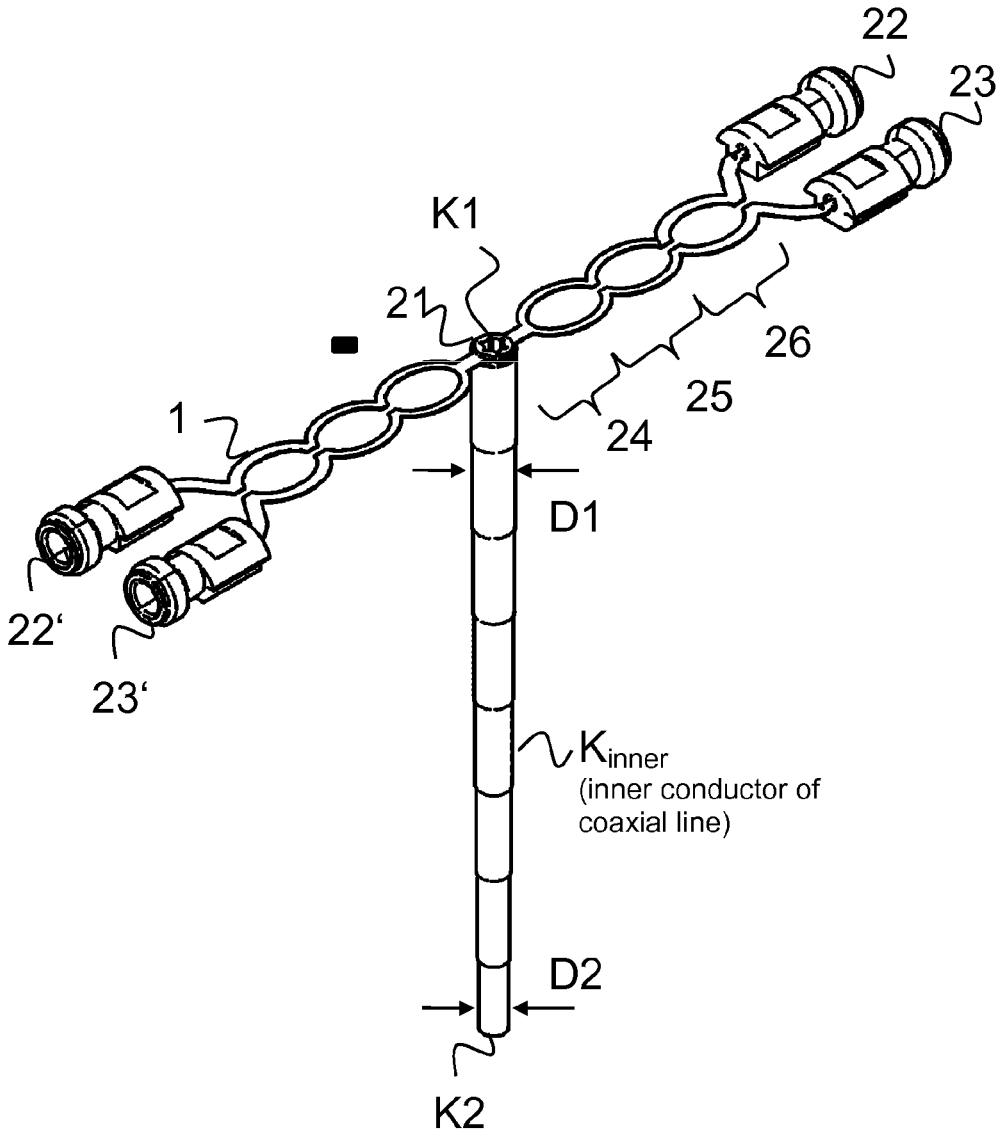
FIG. 12 illustrates a perspective view of the microwave arrangement of FIG. 8 according to example embodiments of the invention.

FIG. 12 shows a perspective view of the microwave arrangement of FIG. 8 according to example embodiments of the invention. In this context, the double—three-stage—Wilkinson voltage splitter 2 is illustrated in FIG. 12 without substrate 3, in order to show with greater clarity the first connection K1 of the inner conductor of the coaxial line $K_{inner}$. Accordingly, the signal ports 22, 23 and respectively 22', 23 are connected to high-frequency signal ports in order to be connected to signal sinks or signal sources disposed downstream. Furthermore, the inner conductor $K_{inner}$ is illustrated, wherein the inner conductor of the coaxial line K provides a diameter D1 at the first connection K1 and a diameter D2 at the second connection K2. As a result of the diameter of the inner conductor narrowing in defined intervals, a transformation of the line wave-resistance of the coaxial line K is achieved, so that a wave-resistance of the coaxial line of 25Ω is connected at the first signal port 21. A standardised 50Ω connection is obtained at the second connection K2 of the coaxial line K. The microstrip line 1 accordingly provides a wave-resistance of 25Ω, so that the microstrip conductor 1 can provide a relatively greater thickness than in the case of a non-transformed coaxial line K and a 50Ω connection applied to the signal port 21.

Figure 13:
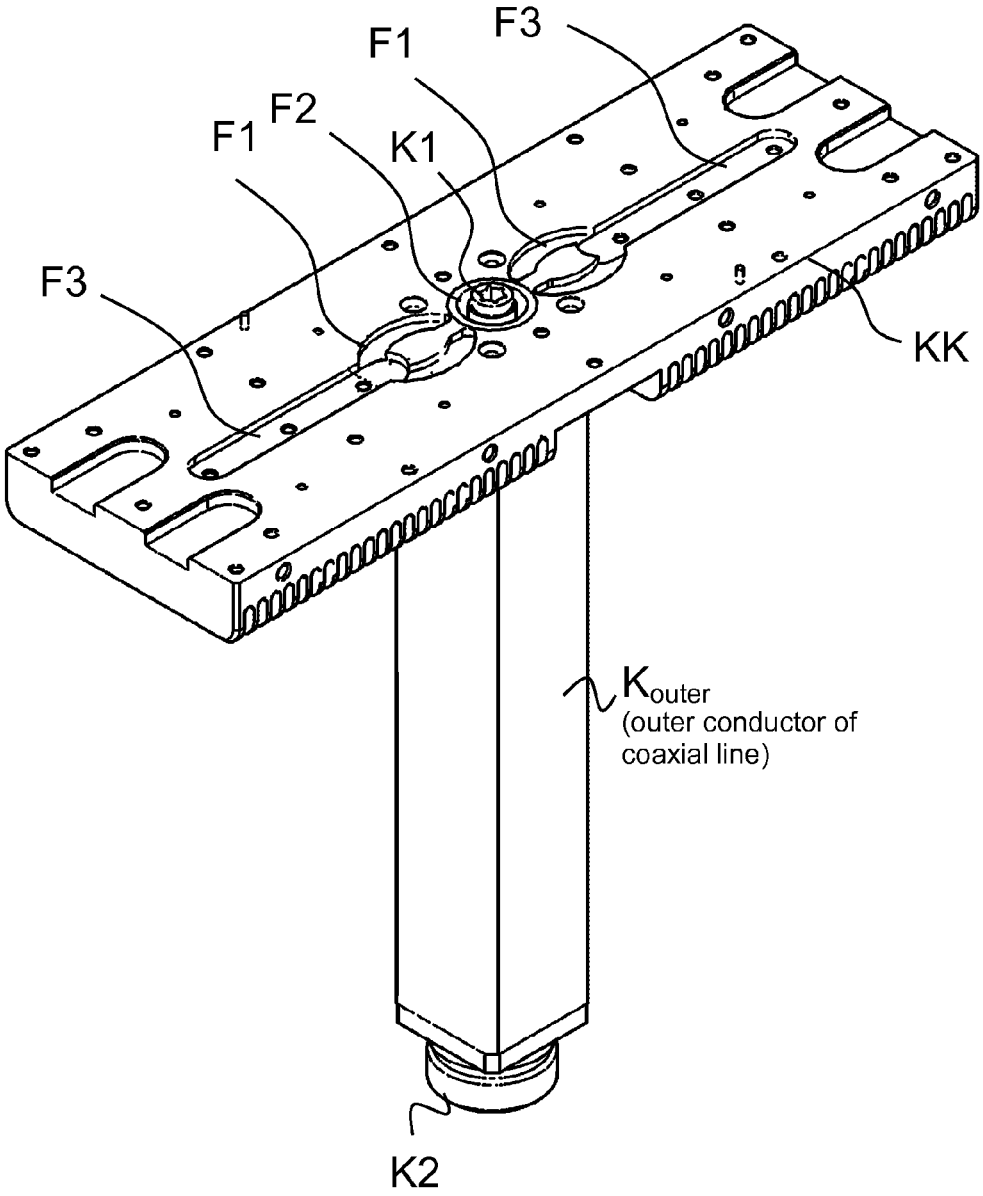
FIG. 13 illustrates a further perspective view of the microwave arrangement of FIG. 8 according to example embodiments of the invention.

As an alternative to FIG. 12, FIG. 13 shows a further perspective view of the microwave arrangement of FIG. 8 according to example embodiments of the invention. In the context of FIG. 13, the outer conductor $K_{outer}$ of the coaxial line K and the cooling element KK are illustrated. Accordingly, the cooling element KK provides a milled region F1 for the defected ground structure 5. The cooling element KK further provides a milled region F3 in order not to influence the electromagnetic effect of the load-terminating resistors R. The inner conductor $K_{inner}$ shown in FIG. 12 extends in the middle of the outer conductor $K_{outer}$ of the coaxial line K. The first connection K1 and also the second connection K2 are also illustrated in FIG. 13. To improve removal of the heat generated by the microwave arrangement, the cooling element KK provides cooling fins on its underside.

Figure 14:
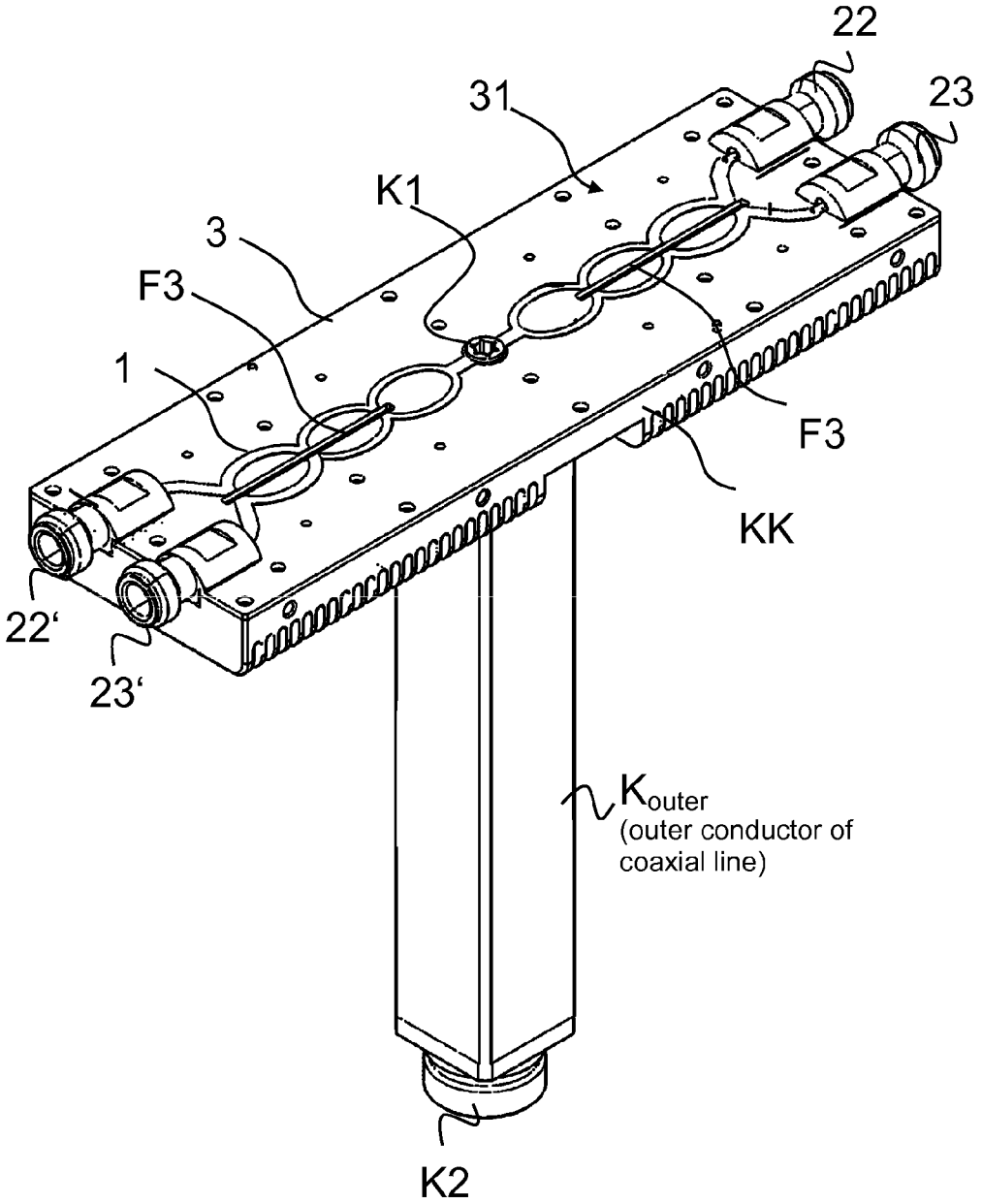
FIG. 14 illustrates a further perspective view of the microwave arrangement of FIG. 8 according to example embodiments of the invention.
Figure 15:
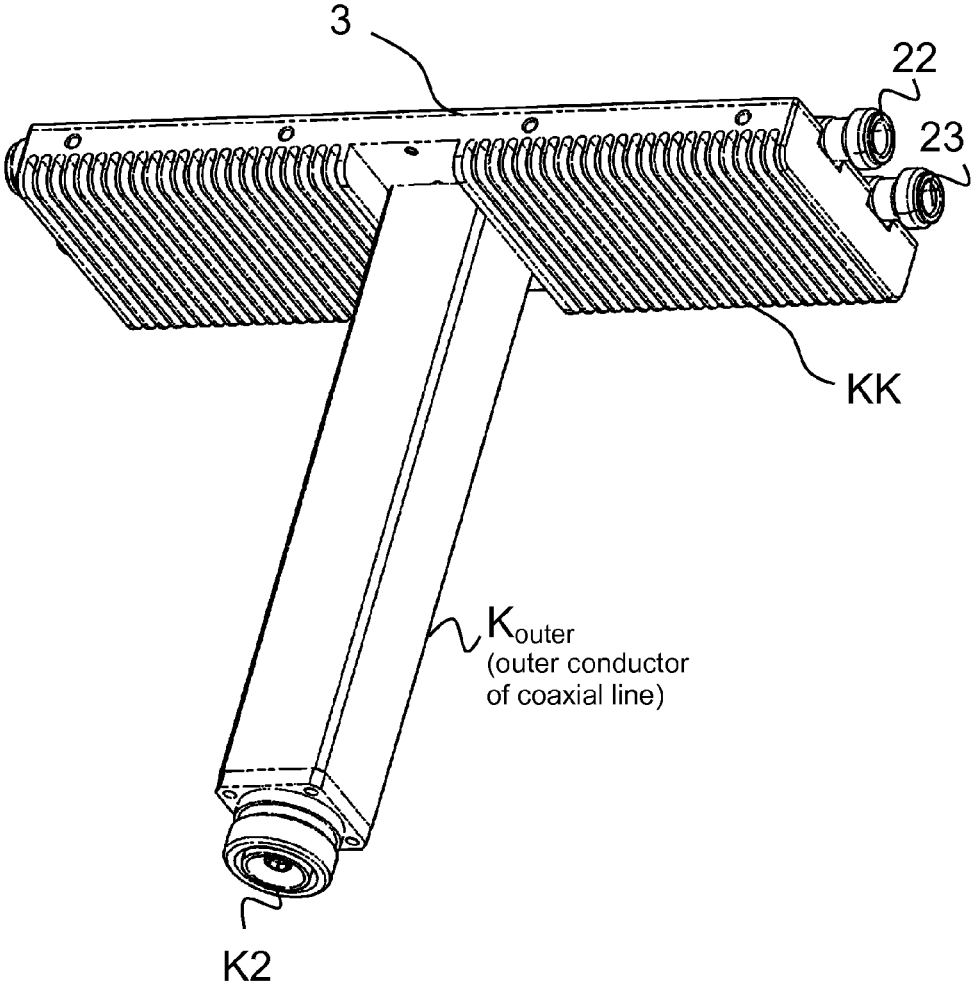
FIG. 15 illustrates a further perspective view of the microwave arrangement of FIG. 8 according to example embodiments of the invention.
Figure 16:
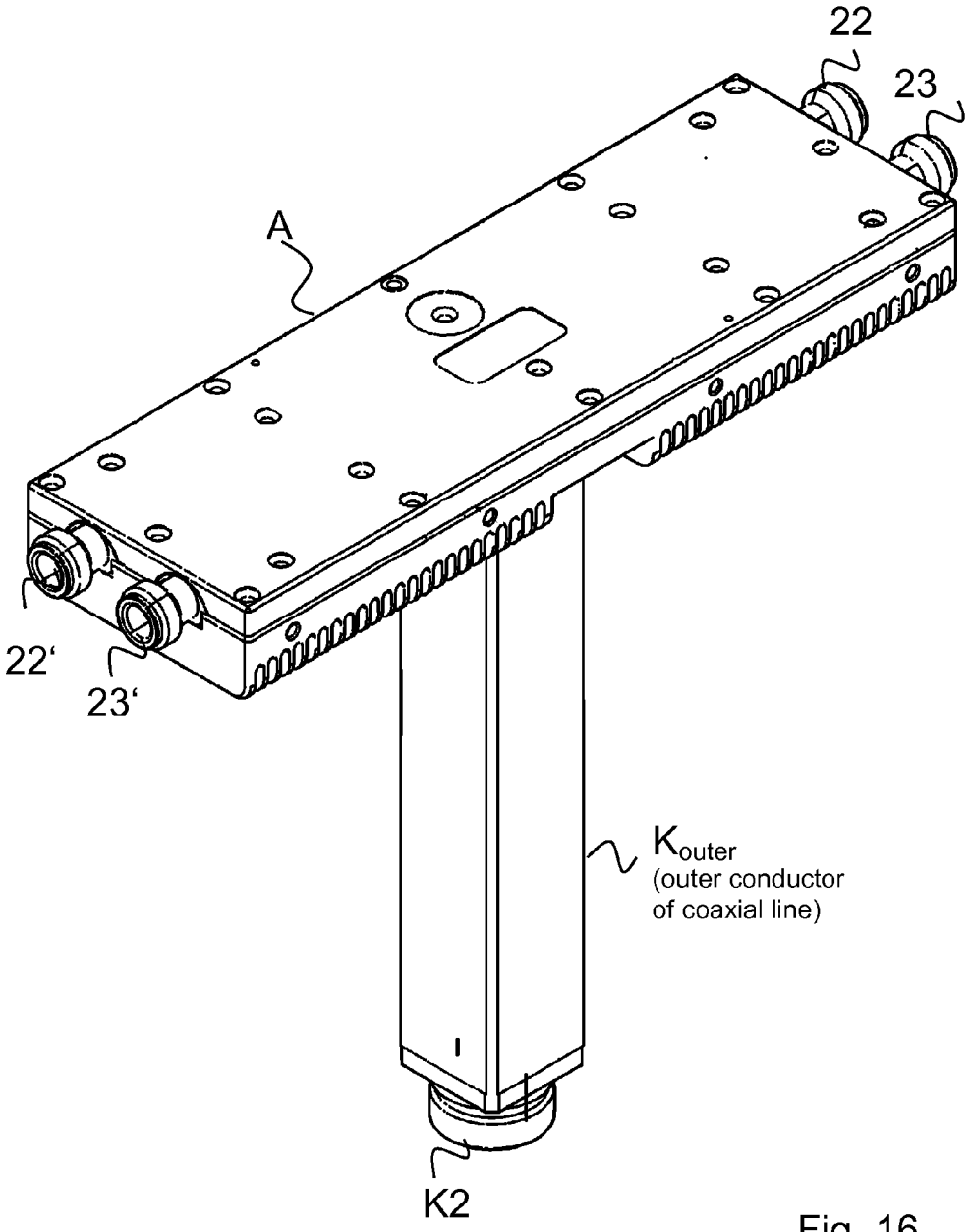
FIG. 16 illustrates a further perspective view of the microwave arrangement of FIG. 8 according to example embodiments of the invention.

As an alternative to FIG. 12 and FIG. 13, FIG. 14 shows a further perspective view of the microwave arrangement of FIG. 8 according to example embodiments of the invention. In this context, the substrate 3 is also illustrated. On the upper side 31 of the substrate 3, the micro-line 1 with the two double—three-stage—Wilkinson voltage splitters 2 is shown. Milled regions F3 are introduced into the substrate 3 to allow the placing of the load-terminating resistors R.

As an alternative to FIG. 12, FIG. 13 and FIG. 14, FIG. 15 shows a further perspective view of the microwave arrangement of FIG. 8 according to example embodiments of the invention. In this view, the cooling fins of the cooling element KK and the second connection K2 of the coaxial line K are shown.

As an alternative to FIG. 12, FIG. 13, FIG. 14 and FIG. 15, FIG. 16 shows a further perspective view of the microwave arrangement of FIG. 8 according to example embodiments of the invention. By way of difference from the preceding Figs., a shielding plate A is arranged above the microstrip line 1. This shielding plate A serves for electromagnetic compatibility and, on the one hand, protects the microwave arrangement according to the invention from interference signals which, without a shielding plate, could interfere unhindered in the signal path, and, on the other hand, from interference signals which are radiated from the microwave arrangement according to the invention and could influence adjacent components.

Within the framework of the invention, all of the elements described and/or illustrated and/or claimed can be combined with one another arbitrarily. The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An apparatus comprising:

a microstrip conductor on a first upper side of a substrate, wherein the microstrip conductor comprises a multi-stage signal splitter; and a ground surface on a lower side of the substrate disposed opposite to the first upper side, wherein the ground surface includes a defected ground structure disposed below a first stage of the signal splitter, wherein a width of the microstrip conductor is configured to achieve a preferred complex line wave-resistance of the microstrip conductor at the first stage of the signal splitter.

2. The apparatus according to claim 1, wherein the multi-stage signal splitter comprises a multi-stage Wilkinson signal splitter with a first signal port, a second signal port and a third signal port, wherein the multi-stage signal splitter is configured such that the power of a signal at the first signal port would be equal to the power of a signal at the second signal port plus the power of a signal at the third signal port, and wherein the first stage of the signal splitter includes a signal-distribution point.

3. The apparatus according to claim 1, wherein the signal splitter further comprises at least one second stage, wherein the first stage of the signal splitter and the second stage of the signal splitter each provide a first line and a second line, and wherein the width of the first and second line of the first stage is equal to the width of the first and second line of the second stage.

4. The apparatus according to claim 1, wherein the defected ground structure is configured as a formed recess in the ground surface, and the shape of the recess of the defected ground structure corresponds to the shape of the microstrip line of the first stage of the signal splitter.

5. The apparatus according to claim 1, wherein the defected ground structure is configured as a formed recess in the ground surface, wherein the shape of the recess of the defected ground structure provides a first two-dimensional recess and a second two-dimensional recess, wherein the first two-dimensional recess and the second two-dimensional recess are connected via a web which is thin relative to the first and second two-dimensional recesses, and wherein, orthogonally to a widening direction of the web, one or more of a first line and a second line of the first stage of the signal splitter is/are arranged on the upper side of the substrate.

6. The apparatus according to claim 5, wherein the ground surface includes at least two defected ground structures.

7. The apparatus according to claim 1, wherein a first connection of a coaxial line is connected to a first signal port of the signal splitter, and wherein, at a second connection remote from the first connection, the coaxial line provides a line wave-resistance value different from the first connection.

8. The apparatus according to claim 1, wherein the substrate is arranged with its underside on a metallic element, wherein the metallic element provides the ground surface, and wherein the metallic element provides a milled region in the region of the defected ground structure.

9. The apparatus according to claim 8, wherein the metallic element serves as a cooling element for removal of heat resulting from operation of the apparatus.

10. The apparatus according to claim 1, wherein each stage of the multi-stage signal splitter includes a load-balancing resistor, wherein the load-balancing resistor is integrated in a milled region of the substrate.

11. An apparatus comprising:

a microstrip conductor on a first upper side of a substrate, wherein the microstrip conductor comprises a multi-stage signal splitter; and a ground surface on a lower side of the substrate disposed opposite to the first upper side, wherein the ground surface includes a defected ground structure disposed below a first stage of the signal splitter, wherein one or more of a resistor, a capacitor and a coil is arranged parallel to the defected ground structure.

12. An apparatus comprising:

a microstrip conductor on a first upper side of a substrate, wherein the microstrip conductor comprises a multi-stage signal splitter; and a ground surface on a lower side of the substrate disposed opposite to the first upper side, wherein the ground surface includes a defected ground structure disposed below a first stage of the signal splitter, wherein a shielding plate is arranged above the first upper side of the substrate.

* * * * *